US006424350B1

(12) United States Patent
Attimont et al.

(10) Patent No.: US 6,424,350 B1
(45) Date of Patent: Jul. 23, 2002

(54) METHOD OF CONTROLLING A LIQUID CRYSTAL DISPLAY

(75) Inventors: Luc Attimont, Le Port Marly; Jannick Bodin, Garches, both of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/273,557

(22) Filed: Mar. 22, 1999

(30) Foreign Application Priority Data

Mar. 26, 1998 (FR) ..... 98 03738

(51) Int. Cl.[7] ..... G09G 3/36
(52) U.S. Cl. ..... 345/545; 345/87
(58) Field of Search ..... 345/97, 104, 38, 345/87, 185, 512, 98, 545; 350/334; 364/900

(56) References Cited

U.S. PATENT DOCUMENTS 4,239,346 A * 12/1980 Lloyd ..... 350/334
4,860,251 A * 8/1989 Bizjak et al. ..... 364/900
5,493,648 A * 2/1996 Murray et al. ..... 345/185
5,717,420 A * 2/1998 Matsuzaki et al. ..... 345/97
5,812,109 A * 9/1998 Kaifu et al. ..... 345/104
5,854,637 A * 12/1998 Sturges ..... 345/512
5,926,159 A * 7/1999 Matsuzaki et al. ..... 345/97
6,140,992 A * 10/2000 Matsuzaki et al. ..... 345/98
6,222,589 B1 * 4/2001 Faroudja et al. ..... 348/448

* cited by examiner

*Primary Examiner*—Steven Saras
*Assistant Examiner*—Srilakshmi K. Kumar
(74) *Attorney, Agent, or Firm*—Sughrue Mion, PLLC

(57) ABSTRACT

A method of controlling a liquid crystal display, the method being of the type requiring refreshment of the displayed information in successive stages, a refresh stage having the following steps: executing at least one request to access a shared memory, so as to collect therefrom information to be displayed; and activating display control members so that the control members perform a refresh operation on the basis of the collected information to be displayed. When, for a refresh stage, the information to be displayed is not available quickly enough, the method performs the following steps: interrupting the access request; and going to a next refresh stage by omitting the activation of the current stage.

3 Claims, 1 Drawing Sheet

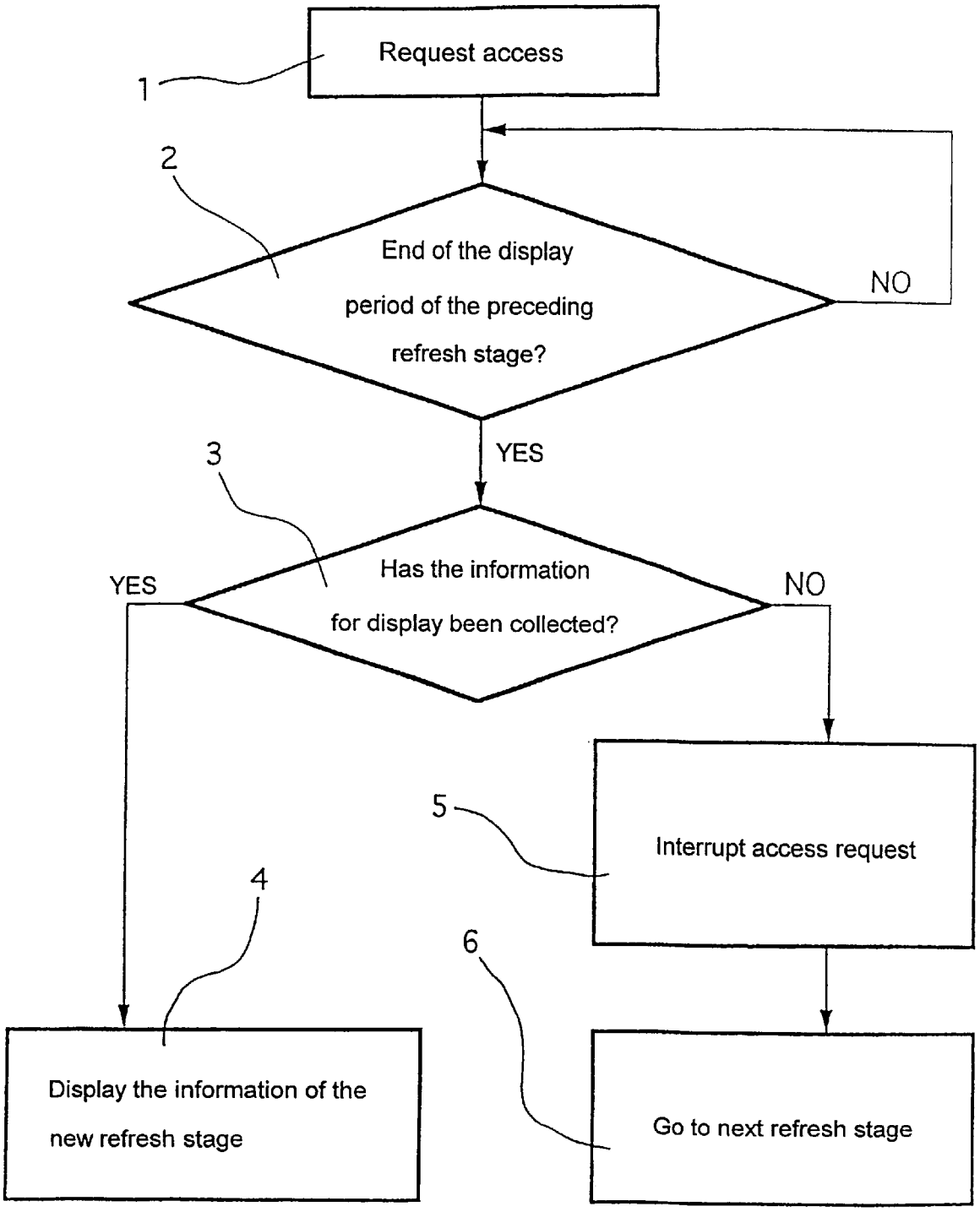
Request access
1
2
End of the display period of the preceding refresh stage?
NO
YES
3
Has the information for display been collected?
YES
NO
5
Interrupt access request
4
6
Display the information of the new refresh stage
Go to next refresh stage

METHOD OF CONTROLLING A LIQUID CRYSTAL DISPLAY

The present invention relates to liquid crystal displays (LCDs).

More precisely, the invention relates to a method of controlling the display on a liquid crystal display, the method being of the type enabling the displayed information to be refreshed in successive stages.

BACKGROUND OF THE INVENTION

Numerous types of apparatus exist that include liquid crystal displays and in which the present invention can thus be implemented. Thus the invention applies particularly, but not exclusively, to a mobile radiocommunications terminal. For example, the mobile terminal may be of one of the following types: GSM 900 (the Global System for Mobile communications, a public mobile radiocommunications system operating in the 900 MHz band), DCS 1800 (Digital Cellular System, operating in the 1800 MHz band), or PCS (Personal Communication System).

In general, a liquid crystal display makes it possible to display information corresponding in particular to at least one image element and/or one text element.

Conventionally, the display requires the displayed information to be refreshed periodically. The principle on which such refreshment in successive stages is based is recalled briefly below.

Generally, the display is organized in rows and columns. For this purpose, each row is driven by a row display command, and each column is driven by a column display command. Thus, in order to display the information to be displayed, each row display command for a row is activated successively for a row display period, and the information specific to the associated row is displayed by activating column display commands in succession. In other words, while a row display command is activated, the other row display commands are maintained in a state in which, for each of them, no display is being commanded in the corresponding row.

In addition, during the display period in which one row is being displayed, the information necessary for displaying the next row must be made available to begin displaying the next row. Unfortunately, conventionally, when not all of the information necessary for displaying the next row is available at the end of display of the current row, this disturbs the display. One of two known solutions is generally implemented, namely: either the display command for the next row is activated regardless, and then, through lack of information, the display is incomplete; or else activation of the display command for the current row is extended, which is not satisfactory either.

In the context of the present invention, it is further assumed that the information to be displayed is saved in a shared memory which is used by one or more users other than the liquid crystal display. The term "other user" is used to mean any element or circuit requiring access to the shared memory and also contained in the apparatus (e.g. a GSM mobile terminal) which itself contains the liquid crystal display. For example, in a radiocommunications terminal, the "other users" of the shared memory may be the following elements: the processor which writes the information to be displayed on the liquid crystal display in the shared memory, and the processor which executes the radiocommunications protocol and uses the shared memory to write information therein or to read information therefrom, it being possible for the two processors to be constituted by a common processor.

In order to refresh the liquid crystal display, it is thus necessary to transfer, periodically, the information to be displayed. Such transfer, from the shared memory to the liquid crystal display, takes place via a common access medium, such as, for example, a memory access bus.

It can be understood immediately that such transfer suffers from the major drawback of occupying the common access medium and the shared memory. In other words, for the other users, the common access medium and the shared memory are unavailable for the entire duration of the transfer. So long as the liquid crystal display has not received the information necessary for displaying the next row, all of the other users are constrained to wait before they can use the common access medium.

In addition, the other users are generally constrained to release the common access medium so as to guarantee that the information necessary for displaying the next row is transferred before the end of the display period of the current row.

This mechanism of waiting, possibly with forced release, is not advantageous because it involves a loss of availability of the common access medium for the other users.

OBJECTS AND SUMMARY OF THE INVENTION

A particular object of the present invention is to mitigate the various drawbacks of the state of the art.

More precisely, an object of the present invention is to provide a method of controlling a liquid crystal display, which method makes it possible to reduce disturbance to the display.

An additional object of the invention is to a provide such a method that makes it possible not to constrain the other users of the common access medium to release said medium in order to guarantee that the information necessary for displaying the next row is transferred before the end of the display period of the current row.

Another object of the invention is to provide such a method that makes it possible to reduce the unavailability of the common access medium for the users other than the liquid crystal display.

Another object of the invention is to provide such a method that makes it possible to optimize use of working resources such as, in particular, the shared memory.

Yet another object of the invention is to provide such a method that is simple to implement and therefore low in cost.

These various objects and others that appear below are achieved by the invention by means of a method of controlling a liquid crystal display, the method being of the type requiring refreshment of the displayed information, in successive stages, a refresh stage comprising the following steps:

- executing at least one request to access a shared memory, so as to collect therefrom information to be displayed; and
- activating display control members so that the control members perform a refresh operation on the basis of the collected information to be displayed;
- wherein, when, for a refresh stage, said information to be displayed is not available quickly enough, said method further comprises the following steps:
  - interrupting said access request; and
  - going to a next refresh stage by omitting said activation of the current stage.

The general principle of the invention is thus as follows: in the absence of new information to be displayed (e.g. at the end of the preceding display period), firstly the access request being executed is interrupted, and secondly the second step of the refresh stage (i.e. the step in which the display control members are activated) is skipped (i.e. omitted). Such skipping (or omission) offers the advantage of reducing liquid crystal display demand on the common access medium, and thus of leaving said medium available for the other users.

In other words, the display control members are "put on hold" (for example, this may correspond to deactivating the display control members for the current row without activating the display control members of the next row).

Thus, unlike in the state of the art, the need to refresh the liquid crystal display is dissociated from availability of the common access medium.

This characteristic is particularly advantageous for any system that has real time constraints. It also enables better use to be made of the available working resources, namely, in particular the shared memory.

In addition, no additional circuit that might increase the complexity of the architecture is necessary. Similarly, no major restructuring needs to be performed compared with the known method of controlling a liquid crystal display. Thus, the invention is simple to implement and therefore low in cost.

It should be noted that the invention imposes no constraint on the number, shape, or type of the image and/or text element(s) to be displayed during the refresh stage in which the display is refreshed.

In a preferred implementation of the invention, each refresh stage consists in displaying a row of image and/or text element(s) displayed by said display.

In other words, no row display command, and specifically neither the command to display the current row nor the command to display the next row, is activated if the information to be displayed on the next row has not been collected by the end of the period for displaying the current row.

BRIEF DESCRIPTION OF THE DRAWING

Other characteristics and advantages of the invention appear on reading the following description of a preferred implementation of the invention, given merely by way of non-limiting example and with reference to the accompanying drawing, in which the sole FIGURE is a simplified flow chart of a particular implementation of a method of the invention for controlling a liquid crystal display.

MORE DETAILED DESCRIPTION

The invention thus relates to a method making it possible to control a liquid crystal display when refreshing the information to be displayed.

With reference to the simplified flow chart of the sole figure, a description follows of a particular implementation of a method of the invention for controlling a liquid crystal display.

It is recalled that a method of controlling a liquid crystal display requires the information on display to be refreshed, in successive stages.

In the remainder of the description, consideration is given to the case when each refresh stage consists in displaying one row of the image being displayed by the liquid crystal display. Clearly, however, the present invention is not limited to this particular row-by-row type of refresh stage.

In conventional manner, each row refresh stage comprises the following steps:

executing (1) a request to access a shared memory so as to collect therefrom information to be displayed by the liquid crystal display; the shared memory is accessed via a common access medium (e.g. a memory access bus); the shared memory also stores information intended for other users; said other users access the shared memory via the same above-mentioned common access medium; and once the display period of the preceding refresh stage has elapsed (positive answer to the question referenced 2), activating (4) the display control members concerned by the new refresh stage if the information for the next refresh stage has been collected; it is recalled that, in the example described herein, these display control members are constituted by the display control member for displaying the current row, and also the various column display control members in succession.

In the invention, even if the answer to the question referenced 2 is positive (i.e. once the display period of the preceding refresh stage has elapsed), the step 4 in which the display control members are activated is not necessarily performed for the new refresh stage. Prior to performing said step, it is determined (3) whether the information to be displayed on the new row (also referred to as the "next row") has actually been collected.

There are thus two different situations, with their respective associated actions:

if the information to be displayed on the next row has been collected, then step 4 is executed in which the display control members concerned by the new refresh stage are activated so as to display the information on the next row; in this first case, the new refresh stage is performed through to its end; and if the information to be displayed on the next row has not been collected in full, then the access request is interrupted (5), and the method goes on (6) to a "subsequent next" refresh stage, omitting to activate the display control members concerned by the "current next" refresh stage for which information is incomplete; in this second case, the "current next" refresh stage is not performed through to the end because information is not to be displayed on the corresponding row.

Thus, in both cases, the common access medium is available to the other users of the shared memory as from the end of the display period of the preceding refresh stage. If the information to be displayed has been collected in full (first case), no further access to the shared memory is necessary via the common access medium. Furthermore, if the information to be displayed has not been collected in full (second case), no attempt is made to continue with collection (which would make the common access medium unavailable to the other users), but instead displaying of the row concerned by the incomplete refresh stage is skipped.

It should be noted that such a characteristic of releasing the common access medium is even more advantageous when the liquid crystal display has a screen of large size.

What is claimed is:

1. A method of controlling a liquid crystal display, the method being of a type requiring refreshment of displayed information in successive stages, a refresh stage comprising the following steps:

executing at least one request to access a shared memory, so as to collect therefrom information to be displayed; and activating display control members so that the control members perform a refresh operation on the basis of the collected information to be displayed;

wherein when, for said refresh stage, said information to be displayed is not available quickly enough, said method further comprises the following steps:

interrupting a current access request; and going to a next refresh stage by omitting said activation of the current stage.

2. A method according to claim 1, wherein each refresh stage comprises displaying a row of image and/or text element(s) displayed by said display.

3. The method of claim 1, wherein said method is performed for a large size liquid crystal display screen.

* * * * *